United States Patent [19]

Butterly, Jr. et al.

[11] Patent Number: 4,843,797

[45] Date of Patent: Jul. 4, 1989

[54] DAIRY CASING METHOD AND APPARATUS

[75] Inventors: Edward R. Butterly, Jr., Brookfield; Doyle Stoppel, Danbury, both of Conn.

[73] Assignee: Doran Brothers Inc., Bethel, Conn.

[21] Appl. No.: 104,394

[22] Filed: Oct. 5, 1987

[51] Int. Cl.[4] ..... B65B 35/36; B65B 5/08

[52] U.S. Cl. ..... 53/448; 53/252; 53/539; 53/543; 198/418.1; 198/418.5; 414/792.6

[58] Field of Search ..... 53/154, 202, 237, 247, 53/248, 252, 437, 438, 448, 537, 538, 539, 543; 198/419, 420; 414/52, 53, 63, 68, 108, 750

[56] References Cited

U.S. PATENT DOCUMENTS

| | | | |
|---|---|---|---|
| 2,520,727 | 8/1950 | Keith, et al | 53/539 |
| 2,681,171 | 6/1954 | Brown, Jr., et al | 53/496 |
| 3,224,549 | 12/1965 | Cella, et al | 198/419 |
| 3,473,289 | 8/1969 | Vadas | 53/497 |
| 3,672,117 | 6/1972 | Shuttleworth et al. | 53/248 X |
| 3,673,756 | 7/1972 | Prete et al. | 53/248 |
| 3,735,561 | 5/1973 | Wood | 53/531 |
| 3,941,236 | 3/1976 | Hagedorn | 198/419 |
| 4,003,185 | 1/1977 | Goff | 53/543 |
| 4,211,056 | 7/1980 | Birk | 53/543 |

FOREIGN PATENT DOCUMENTS

| | | | |
|---|---|---|---|
| 810795 | 3/1959 | United Kingdom . | |
| 1464245 | 2/1977 | United Kingdom . | |
| 1588408 | 4/1981 | United Kingdom | 53/543 |

*Primary Examiner*—Robert L. Spruill
*Assistant Examiner*—Beth Bianca
*Attorney, Agent, or Firm*—Mattern, Ware, Stoltz & Fressola

[57] ABSTRACT

High speed dairy casing methods and apparatus assemble columns of filled containers arriving on two infeed conveyors, transfer one, two or more columns to an assembly ramp adjoining each conveyor, and then sweep the assembled columns from the conveyor and the ramp together across the ramp to an adjacent loading zone for casing, leaving the assembly ramp free for assembling succeeding columns while case loading is proceeding. Preferably two infeed conveyors deliver filled containers into two separate assembly zones with their ramps flanking a central loading zone, and a pusher with two extended positions propels each single column from its conveyor onto the assembly ramp, and then propels the final column with the assembled columns together across the ramp to the loading zone as the pusher advances to its remote extended position. Programming of limit sensors and pusher controls, and re-positioning of adjustable guides and guide-plates adapts the modular casers of this invention to assemble many different sizes of containers, and to load them into one or two cases, utilizing either one or two infeed conveyors.

8 Claims, 9 Drawing Sheets

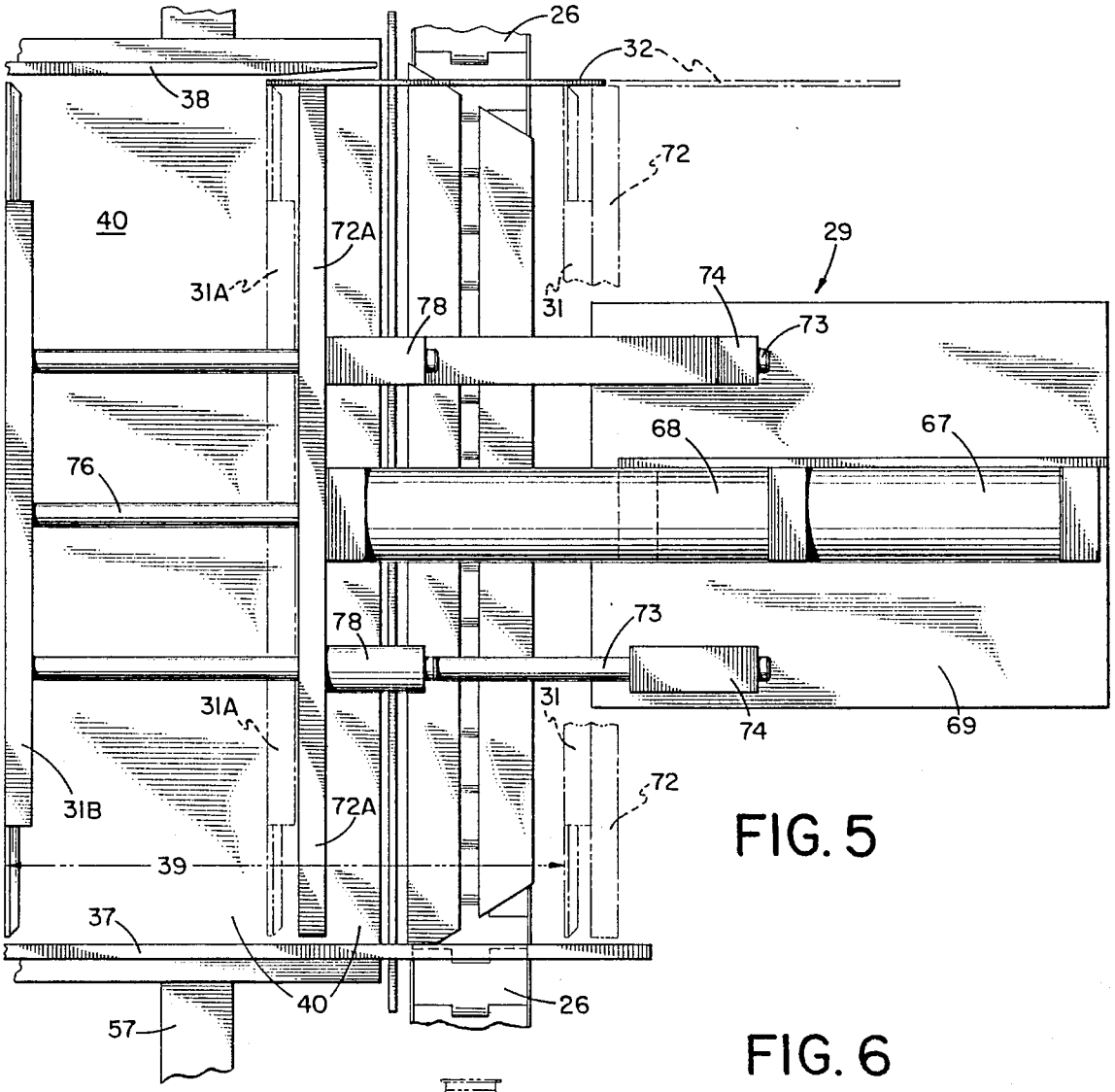
FIG. 5
FIG. 6
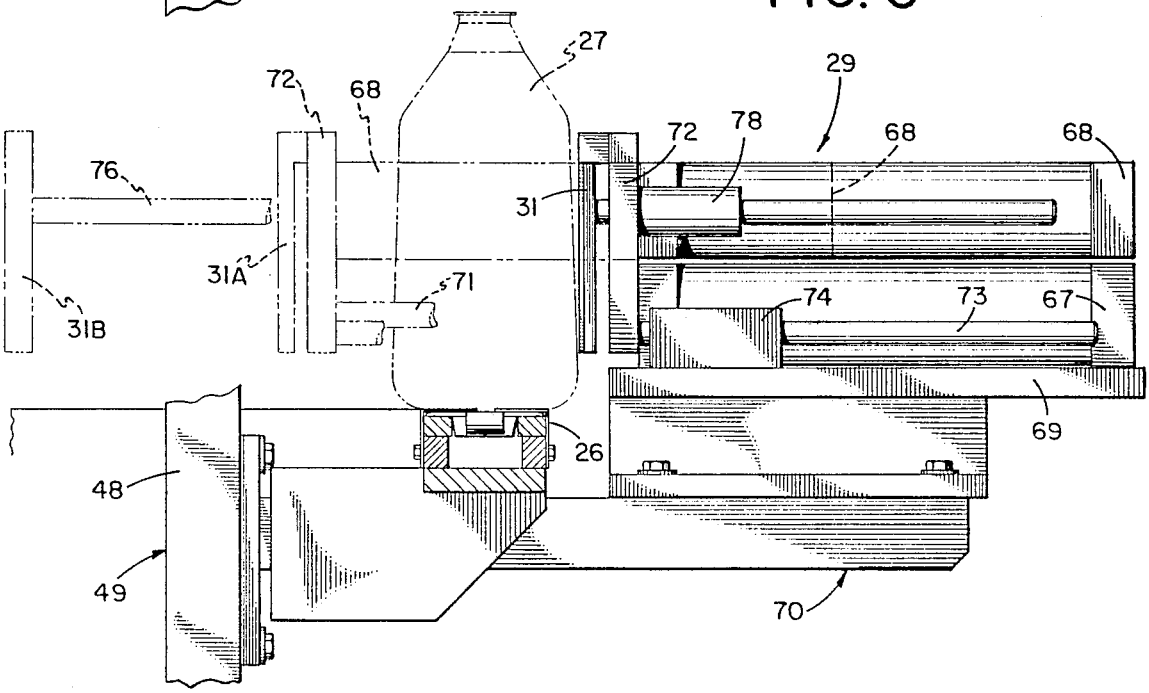

DAIRY CASING METHOD AND APPARATUS

This invention relates to casing machines for assembling and loading objects or containers into carrying cases, and more particularly, to production casers employed in bottling plants and dairies utilizing infeed conveyor lines of filled containers arriving at a casing station wherein containers advancing along two infeed conveyors are assembled on assembly ramps and propelled sidewise to a loading zone, where they are gripped and lowered together into one, two or more cases positioned on a delivery conveyor line below the loading zone.

BACKGROUND OF THE INVENTION

Prior art casing machines have assembled advancing lines of containers directly in the loading zone by pushing groups of containers sidewise until enough rows of containers were assembled there for casing. Two prior patents have assembled containers advancing down a conveyor line by alternately pushing groups of containers to the right and to the left, to subordinate conveyor lines, where they advance a short distance and are then pushed back toward a central loading zone to be loaded into cases. Examples of such casing techniques are shown in Keith U.S. Pat. No. 2,520,727, and Birk U.S. Pat. No. 4,211,056. Keith's FIGS. 18 through 23 and Birk's FIGS. 13 through 15E clearly show the alternate lateral pushing of groups of containers to right and to left, and their subsequent return, pushed back toward a central loading zone.

A major disadvantage of such prior art case loaders is their limitation to the delivery rate of filled containers advancing toward the loading zone along a single conveyor line, or down two parallel conveyor lines if the container filling operation is conducted on parallel lines, as suggested at Column 3, Lines 59–62 of Birk U.S. Pat. No. 4,211,056, and this delivery rate is reduced by interruption of conveyor operation during every case loading operation.

The lateral pushers propelling the arriving filled containers from the parallel conveyor lines inward toward a central loading zone between them must necessarily each incorporate a gate panel blocking the advance of oncoming filled containers, during the time a group of containers is being pushed inwardly from the conveyor toward the loading zone. This requires that the case loading operation necessarily proceeds at a slower pace than the container filling operation. In Column 4, Line 33, the Birk Patent refers to "staging areas A and B" disposed laterally on opposite sides of the loading station I. However, an examination of Birk's FIG. 15A clearly shows that staging areas A and B coincide exactly with conveyors 24 and 25, and there are no separate staging areas between these infeed conveyors and the loading zone, represented by the two trap doors 30 supporting the filled containers until they are lowered into the underlying case. The seizing, gripping and lowering of the filled containers from the loading zone downward into the underlying case necessarily occupies a predetermined finite length of time, during which a single column of filled containers may advance down each infeed conveyor. Until the case loading operation is completed, however, the trap doors of these prior art loaders must remain open, and no sidewise assembly or staging of these delivered filled containers can be performed while they are open and the conveyors are blocked.

With the unique modular casers of the present invention, however, delivery of filled containers along both infeed conveyors may proceed virtually without interruption.

This nearly continuous operation of the casers of this invention results from the incorporation of an assembly ramp positioned beside the loading zone, interposed between the loading zone and the infeed conveyor. Preferably two parallel infeed conveyors are employed, flanking the loading zone, each forming with the assembly ramp a separate assembly zone connecting each conveyor to the loading zone. One or two rows of filled containers may be in the process of assembly on one of these assembly ramps while the assembled containers from the other assembly ramp and conveyor are delivered to the loading zone, seized, gripped and lowered into the underlying case. At the same time, a new group of filled containers can begin assembly in the previously cleared assembly zone while the loading operation is proceeding to completion.

In this manner, the normal progression of filled containers along both delivery conveyors is virtually uninterrupted, and the brief delay caused by lateral pushing of containers from a conveyor onto the assembly ramp or into the loading zone results in minimum periods of interruption of the overall advancing conveyor columns. The delay occasioned by the seizing, gripping and lowering of the assembled group of filled containers through trap doors or otherwise, from the loading zone into the case, does not significantly delay the normal advance of filled containers along the infeed delivery conveyors.

Accordingly, a principal object of the present invention is to provide rapid and virtually uninterrupted casing operations performed upon two advancing lines of filled containers, closely matching the rate of container case loading to the rate of container filling for maximum efficiency.

Another object of the invention is to provide container case loading methods and apparatus utilizing a pair of assembly ramps flanking the loading zone, respectively interposed between the loading zone and one of the filled container delivery conveyors.

A further object of the invention is to provide modular casing methods and apparatus for advancing filled containers delivered by conveyor lines which may be employed with a single line and may subsequently be expanded to accept two infeed conveyor lines by making only minor additions and adjustments to the original casing apparatus.

Other objects of the invention will in part be obvious and will in part appear hereinafter.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

THE DRAWINGS

For a fuller understanding of the nature and objects of the invention, reference should be made to the following detailed description taken in connection with the accompanying drawings, in which:

FIG. 5 is an enlarged fragmentary top plan view showing the retracted position of one of the lateral pushers together with its two different extended positions.

FIG. 6 is a corresponding fragmentary front elevation view partially in section showing the same lateral pusher in its retracted position and in its two extended positions.

Figure 7:
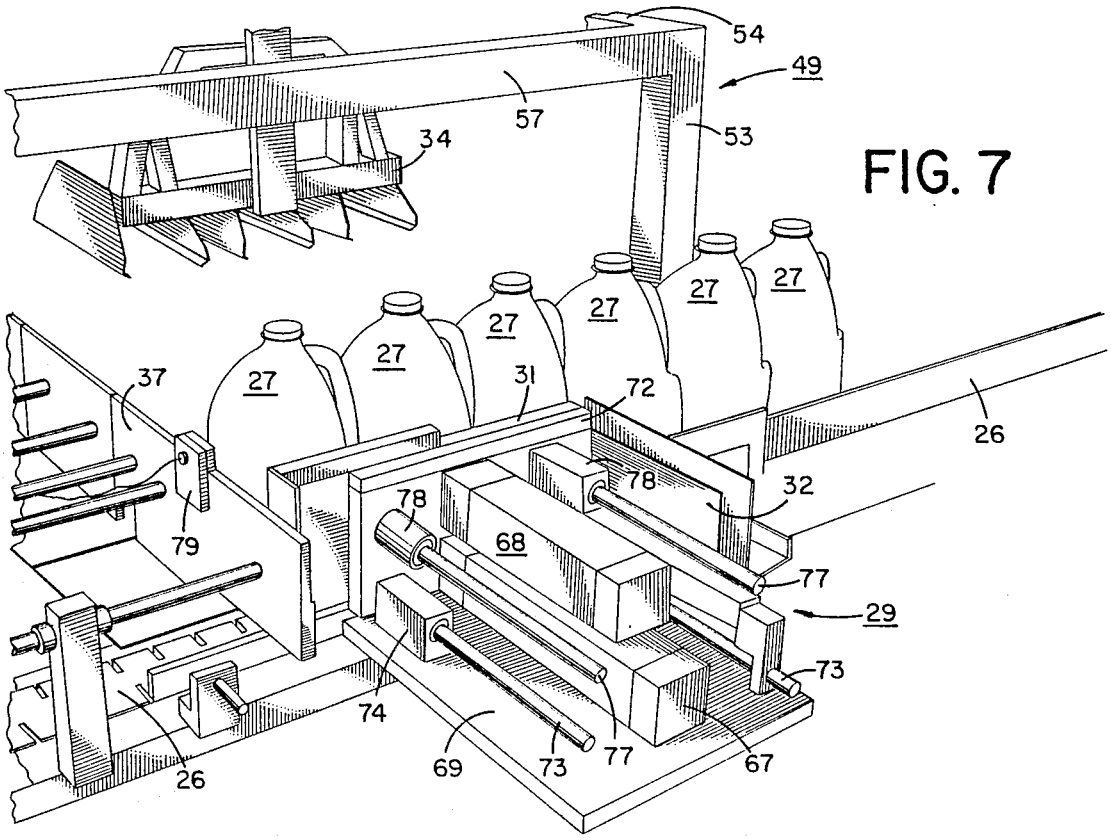
Figure 8:
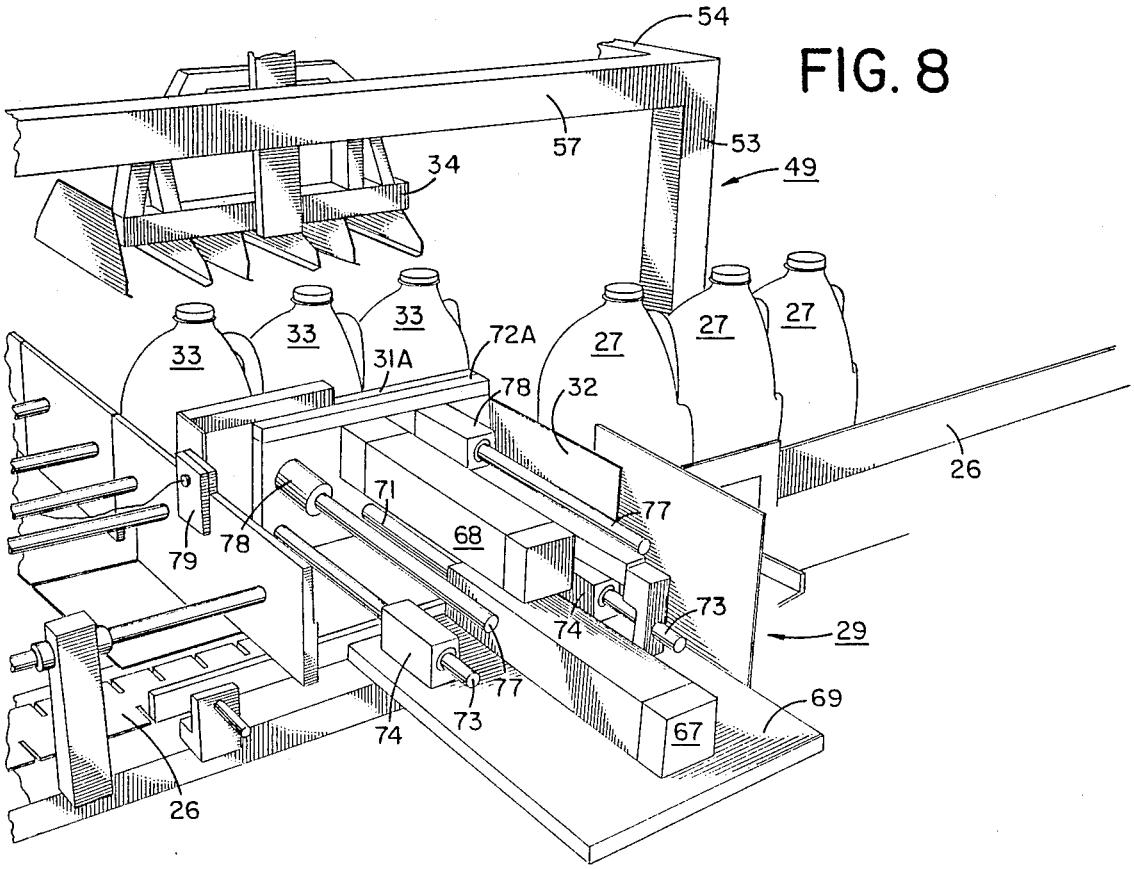
Figure 9:
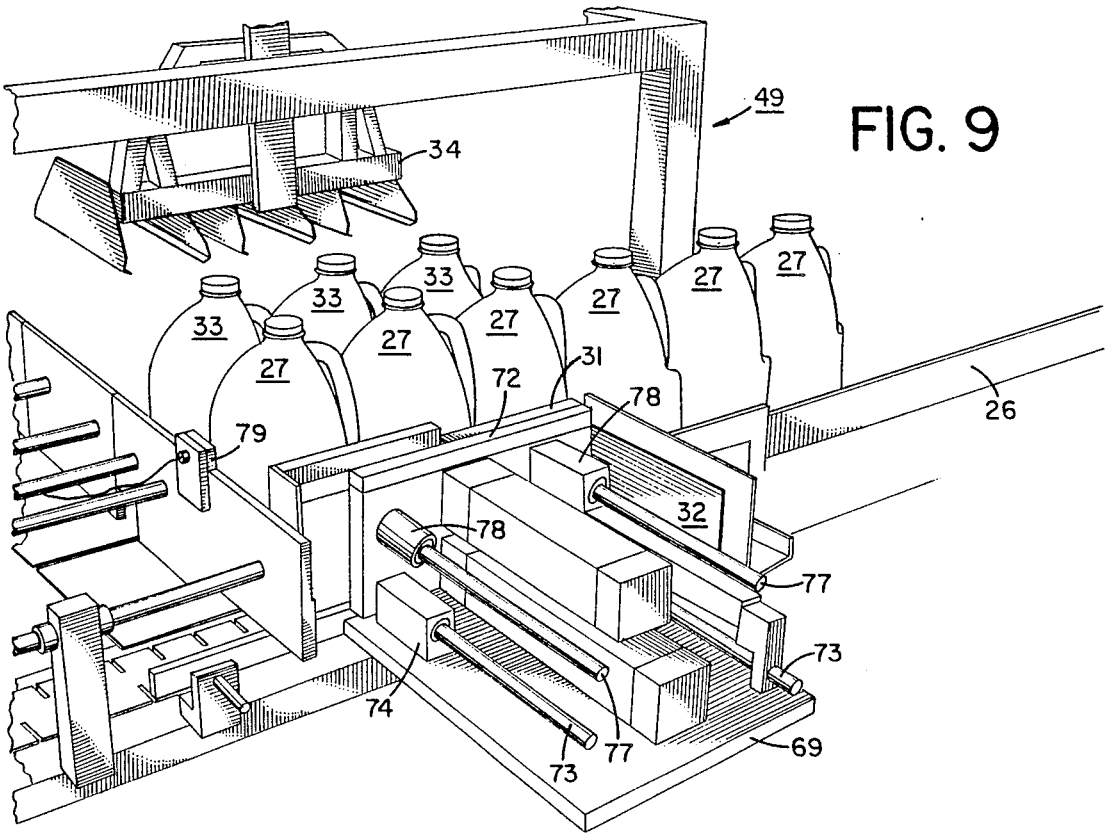
Figure 10:
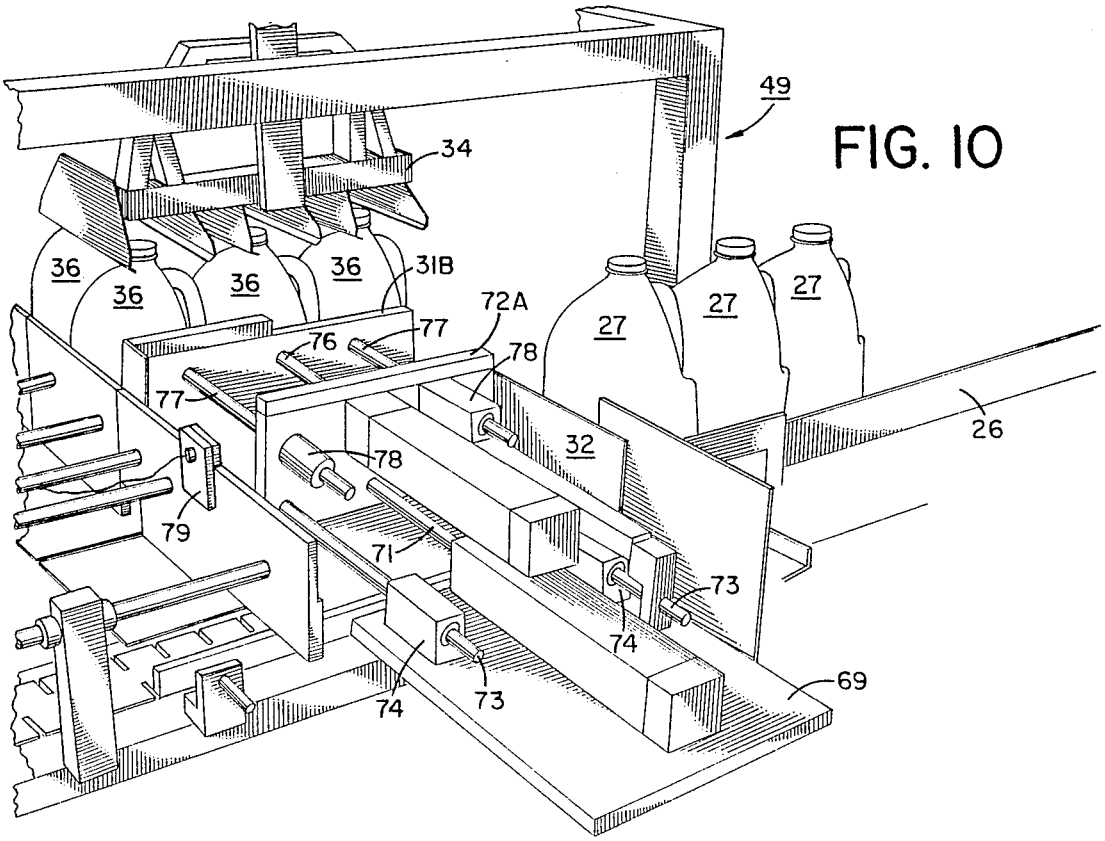

FIGS. 7, 8, 9 AND 10 are fragmentary schematic perspective views of a slightly modified pusher, similar to the pusher of FIGS. 5 and 6, showing four successive stages of its operating cycle as it receives a line of filled containers advancing down one of the infeed conveyors, assembles the filled containers in the assembly zone in FIGS. 8 and 9, and delivers the assembled group of filled containers to the loading zone in FIG. 10. FIGS. 11A–11E are successive top plan view diagrams showing successive stages in the operation of a modular caser of the present invention receiving filled containers advancing along only the single left infeed conveyor.

FIGS. 11F–11P are corresponding schematic top plan diagrams showing the same modular caser in successive stages of its operation, as filled containers are delivered initially from the left infeed conveyor and then also from the right infeed conveyor.

FIGS. 12A–12H are similar schematic top plan diagrams showing successive stages in the case loading operation, loading two groups of nine containers simultaneously into two cases, utilizing the filled containers delivered down two infeed conveyors simultaneously and employing the assembly ramps characterizing the present invention to minimize interruptions in the advance of filled containers and to make the casing operation highly efficient.

THE BEST MODE FOR CARRYING OUT THE INVENTION

Figure 2:
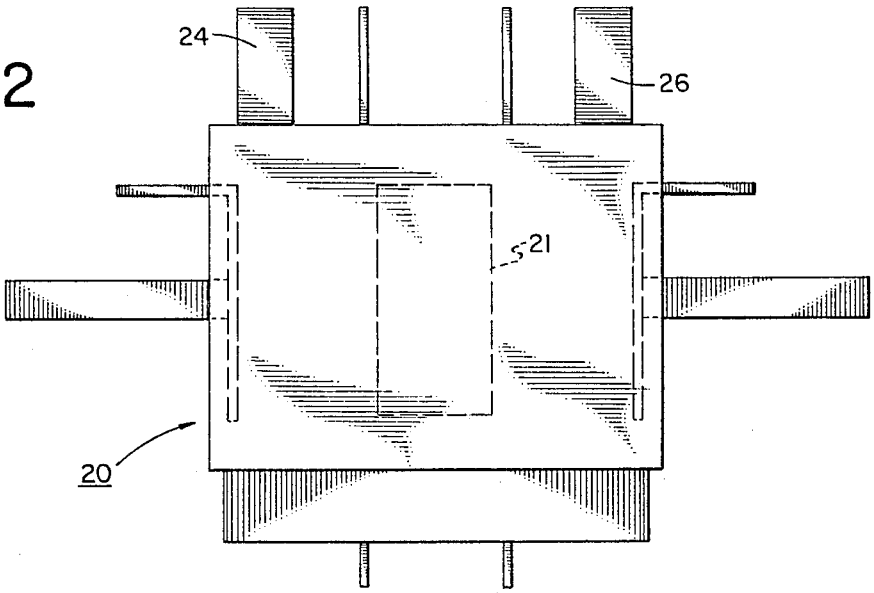
FIG. 2 is a schematic top plan view of the modular caser apparatus shown in FIG. 1.
Figure 1:
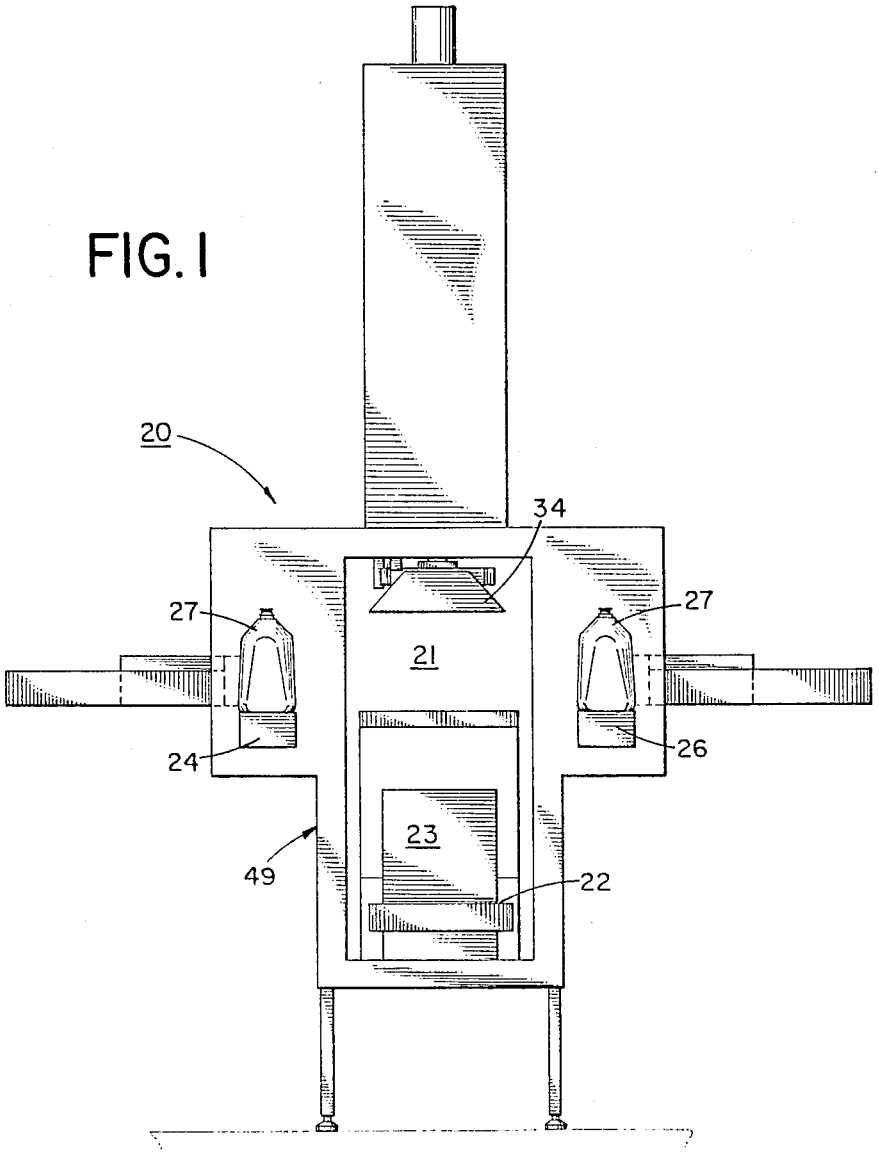
FIG. 1 is a schematic front elevation view of the casing apparatus embodying the present invention showing filled containers arriving on two infeed conveyor lines flanking a loading zone into which they are pushed by lateral pushers.
Figure 3:
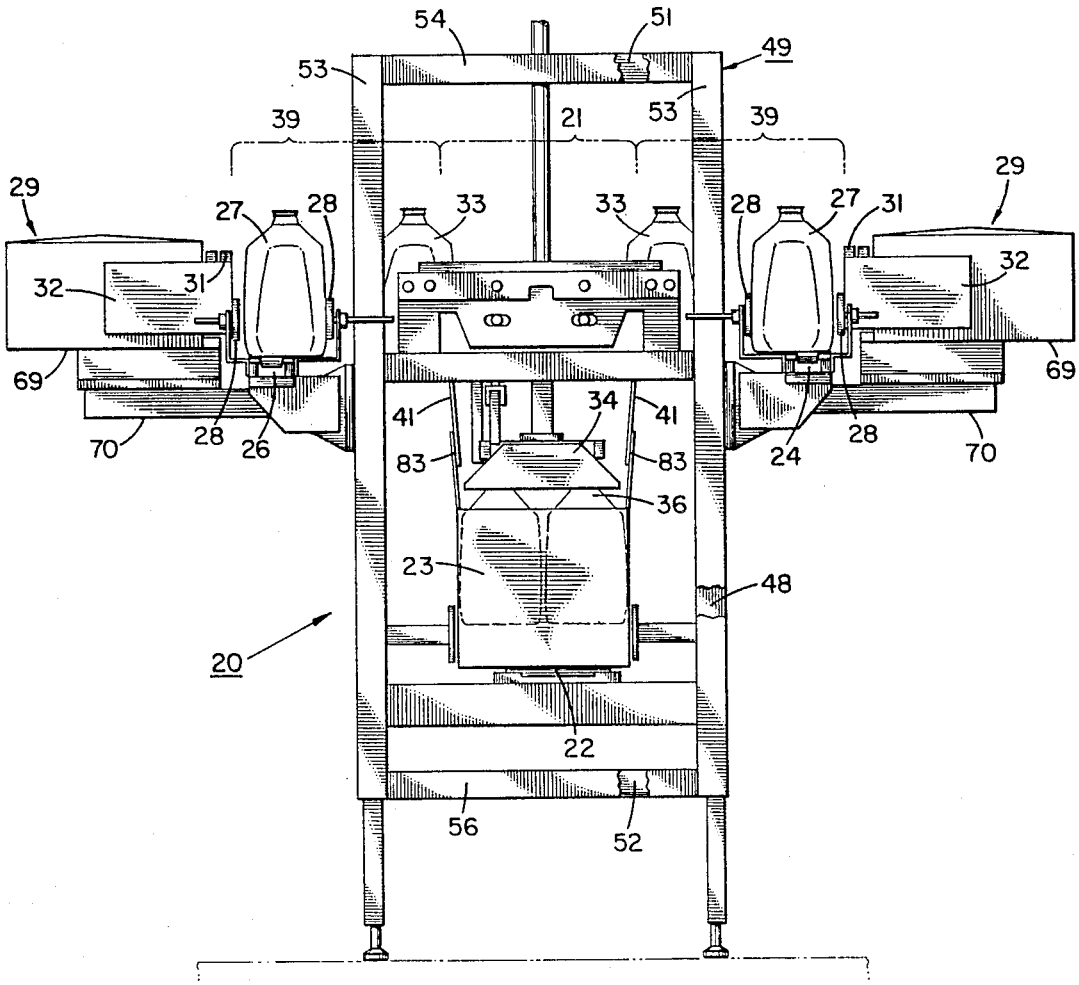
FIG. 3 is a schematic rear elevation view of the modular caser embodying the invention, illustrating the position of the various parts during the actual case loading portion of the operation cycle.

The schematic views of FIGS. 1 and 2 and the more detailed rear view of FIG. 3 shows the principal components and subassemblies of the modular casers of the present invention. Caser 20 incorporates a frame 49 enclosing a loading zone 21 positioned centrally at an elevated level within the device, above a case conveyor 22 on which advancing empty cases 23 are delivered to the position just under loading zone 21, where they are halted for loading. A pair of infeed conveyors, a left infeed conveyor 24 and a right infeed conveyor 26, are positioned to deliver filled containers 27 into the rear portion of caser 20, flanking loading zone 21.

The more detailed rear view of FIG. 3 illustrates the adjustable side guides 28 mounted on each side of the infeed conveyors 24 and 26. The lateral pushers 29 with their pusher plates 31 and gate panels 32 are shown flanking the infeed conveyors 24 and 26 in FIG. 3. In addition, FIG. 3 shows the assembled rows of containers 33 on the assembly ramps immediately adjacent the loading zone 21. The gripper head 34 shown above loading zone 21 in FIG. 1 is illustrated near the lower end of its vertical loading stroke in FIG. 3, where the gripped containers 36 have been lowered almost to the bottom of the empty case 23 which is being loaded by the casing apparatus.

Assembly Zones

FIG. 3 illustrates the continuous assembly operation of the device during the actual loading operation, which is also illustrated in FIGS. 11K, 11M, 11P, 12F and 12H. As shown in these views of the drawings, advancing delivery of filled containers along the infeed conveyors and assembly of the next two full loads of filled containers on both of these conveyors and their assembly ramps flanking the loading zone 21 continues uninterrupted during the actual loading of containers 36 into case 23, this making the modular caser of this invention significantly more efficient than those of the prior art.

Figure 4:
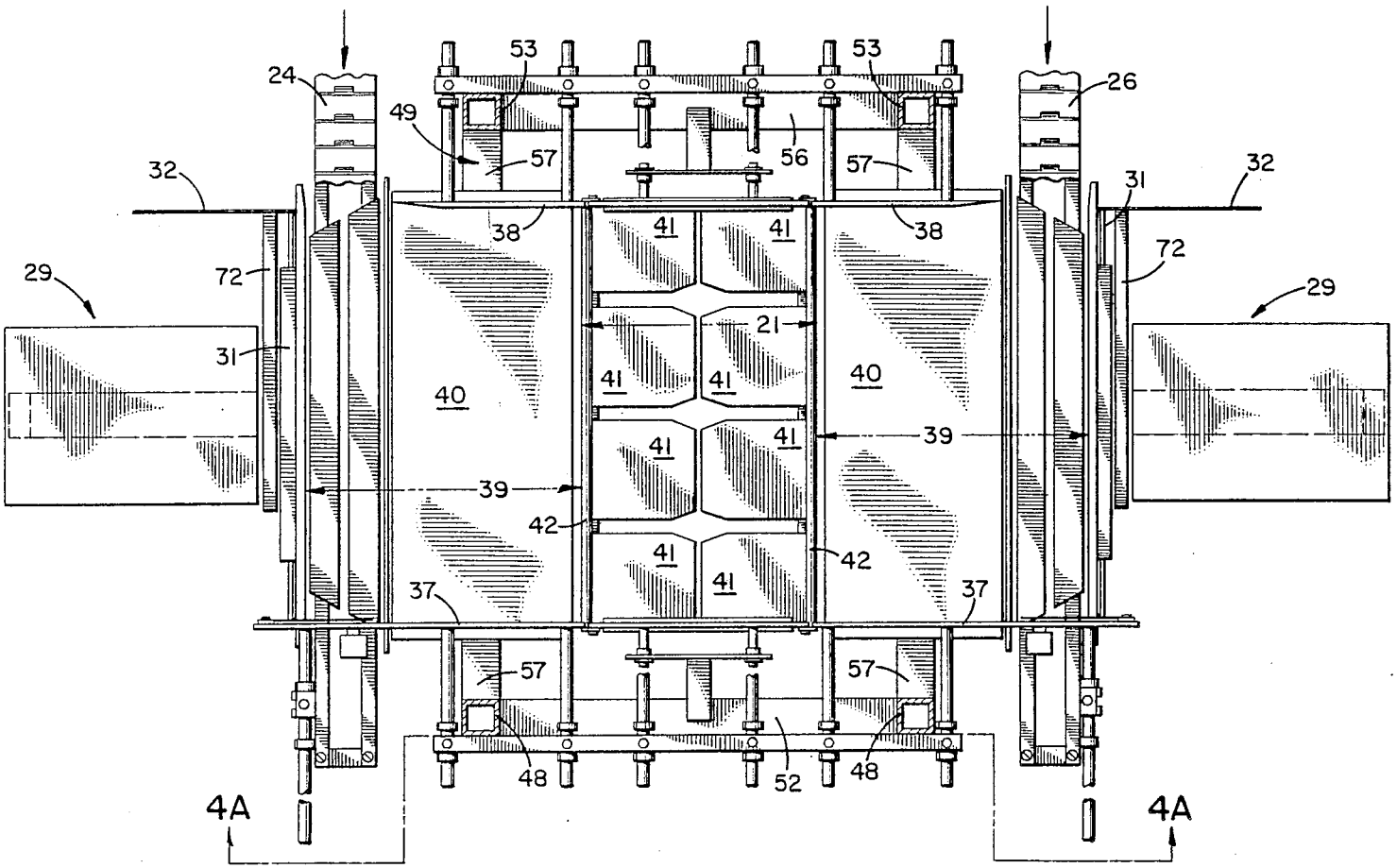
FIG. 4 is an enlarged cross-sectional top plan view of the loading zone portion of the same modular caser, showing assembly ramps flanking the central loading zone and interposed between the loading zone and two infeed conveyors, with lateral pushers mounted beyond the conveyors.
Figure 4A:
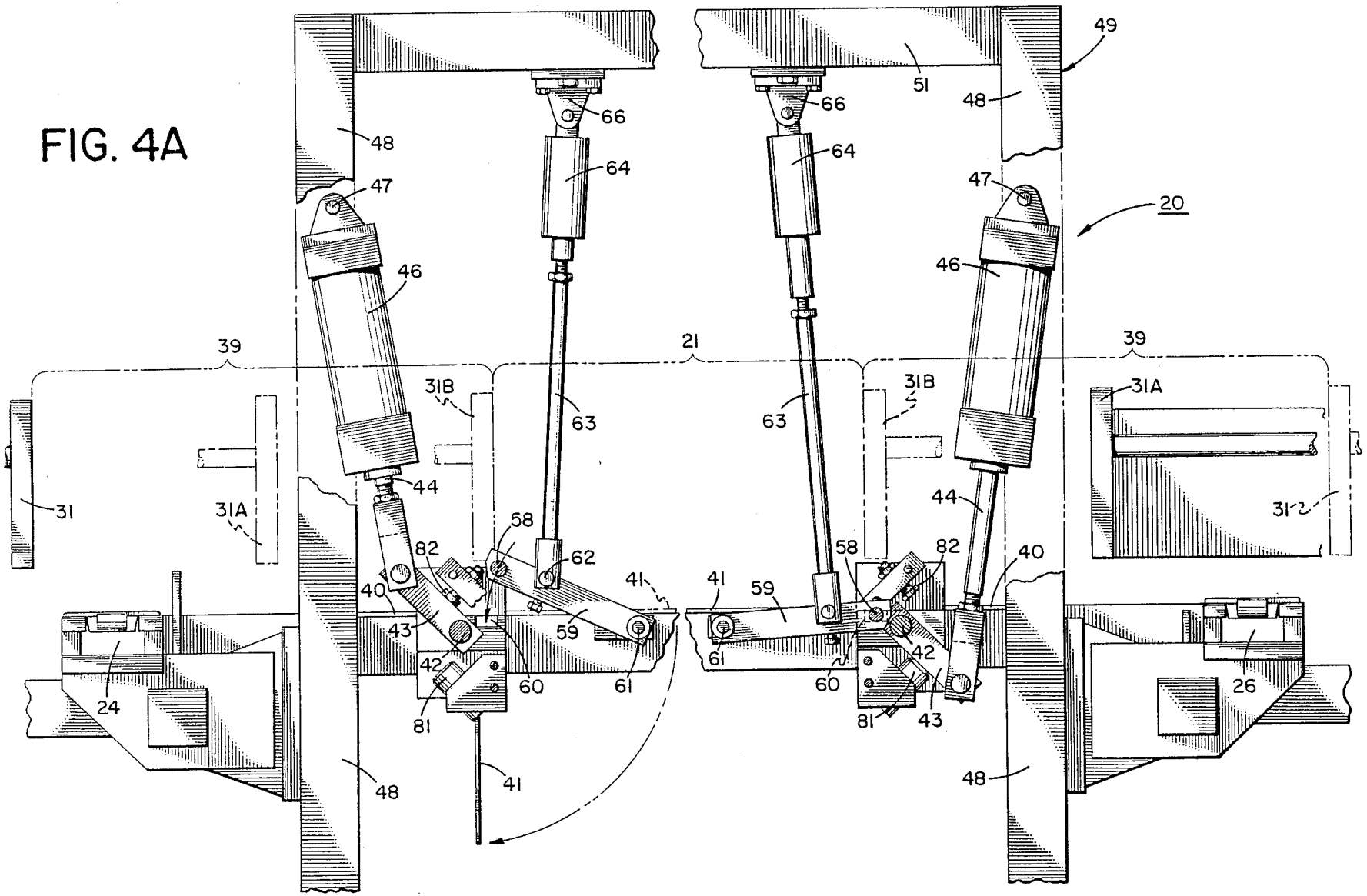
FIG. 4A is a further enlarged fragmentary front elevation view partially in section showing the actuating mechanism associated with the loading zone portion of the device.

The components and subassemblies employed to move filled containers from the two infeed conveyors across the assembly zone ramps to the loading zone are illustrated in FIGS. 4 and 4A. Loading zone 21 comprises a rectangular region in the central portion of the housing frame 49, as illustrated in FIG. 4. The width of loading zone 21 corresponds to the interior width of the case 23 to be loaded, while the length of loading zone 21 in the direction of travel of the infeed conveyors 24 and 26 corresponds to the interior length of two such cases to be loaded, since the methods and apparatus of the invention are intended to load a plurality of filled containers into two cases simultaneously.

If desired, however, only the central portion of the loading zone 21 corresponding to the length of a single case may be employed. In this instance, adjustable end guide plates 37 and 38 may be moved toward each other, and a pusher plate 31 having a shorter length corresponding to the internal length, of a single case may be employed to reciprocate between the more closely spaced guide plates 37 and 38. Positioned on each side of loading zone 21 is an assembly zone 39 extending from the lateral edge of loading zone 21 laterally outward across its assembly ramp 40 to the retracted position of the pusher plate 31 beyond the infeed conveyors 24 and 26, shown in FIG. 4. Thus each assembly zone 39 includes its ramp 40 plus the adjacent delivery end of the infeed conveyor 24 or 26, as shown in FIGS. 11A, 11B, 11F, 12A, 12E and 12F.

Loading Zone Trap Doors

As indicated in the figures, loading zone 21 is bounded by an underlying pair of pivoted trap door plates 41, each anchored to a lengthwise pivot shaft 42 extending along its outer lateral edge, pivotally mounted in frame 49. The raised position of trap door 41 is shown in FIG. 4 and at the right-hand side of FIG. 4A, and in dash lines at the left side of FIG. 4A, while the lower position of trap door plate 41 is shown in solid lines at the lower left portion of FIG. 4A and in FIG. 3.

A crank arm 43 anchored to each pivot shaft 42 extends radially therefrom and preferably slanting downward and outward in the general direction of the adjacent infeed conveyor.

For actuating the trap door plates 41, pivotally connected to the distal end of each crank arm 43 is a piston rod 44 whose opposite end is secured to a piston inside a pneumatic actuating cylinder 46. The opposite end of each cylinder 46 is pivotally joined by a pivot connection 47 to a structural frame member, front column 48 forming part of the housing frame 49 supporting the movable components of caser 20. The retracted position of piston rod 44 inside cylinder 46 is illustrated at the left-hand side of FIG. 4A raising crank arm 43 and swinging the left trap door 41 clockwise downward about its pivot shaft 42 to the open trap door position illustrated in FIG. 3.

The extended position of piston rod 44 protruding downward from cylinder 46 is illustrated at the right-hand side of FIG. 4A positioning crank arm 43 downward to raise the right-hand trap door 41 to its upper horizontal position forming a floor underneath loading zone 21 to support filled containers propelled into the loading zone 21 by pusher plate 31.

As indicated in the drawings, the structural frame 49 incorporates four vertical columns 48 and 53, each forming one of the corner members of a box frame structure enclosing the loading zone 21 and substantial portions of the assembly zones 39. As shown in FIG. 3, the pair of front columns 48 are anchored in position by a transverse horizontal frame member 51 joining the upper ends of column 48, and also by a similar transverse lower horizontal frame member 52.

Members 48, 51 and 52 thus form a rectangular front frame portion at the downstream end of the unit 20. A similar pair of rear columns 53 joined by a top frame member 54 and a lower frame member 56 form a similar rectangular rear frame portion at the upstream end of caser 20, as illustrated in FIGS. 3, 7 and 8 for example. The two rectangular frame portions are formed into a completed box frame structure 49 by lengthwise frame members 57 spanning the top and the bottom of the caser unit 20 parallel to the infeed conveyors 24 and 26, as indicated in FIGS. 4, 7 and 8. These frame members may be formed of rolled bars or angle sections, but for rigidity, light weight and cleanliness in dairies and beverage bottling plants, square box sections are preferred, as shown in the drawings.

Barrier Rods

Extending lengthwise along the outer lateral edges of both sets of trap doors 41 near each pivot shaft 42 is a barrier rod 58, parallel to shaft 42, which may be lowered to a lowermost retracted position shown at the right-hand side of FIG. 4A, substantially entirely embraced in a groove 60 recessed below the upper surface of the raised trap door plate 41, and raised to an uppermost position well above the upper surface of the trap door plates, as shown at the left-hand side of FIG. 4A. The ends of both barrier rods 58 are mounted in pivoted arms 59, whose opposite ends are pivotally connected to a transverse frame member by pivots 61.

Pivotally joined to an intermediate portion of each arm 59 by a pivot connection 62 is a piston rod 63 whose opposite piston end is positioned inside a pneumatic actuating cylinder 64, whose remote end is itself pivotally mounted to the structural frame 49 of caser unit 20, by such means as the pivot mounting 66 bolted to transverse top horizontal frame member 51, as shown in FIG. 4A.

The extended position of piston rod 63 lowering barrier rod 58 into its retracted lowermost position below the upper surface of trap door plate 41 is shown at the right-hand side of FIG. 4A. The upper retracted position of piston rod 63 raising barrier rod 58 to its uppermost position above the upper surface of trap door plates 41 is shown at the left-hand side of FIG. 4A.

Figure 11A:
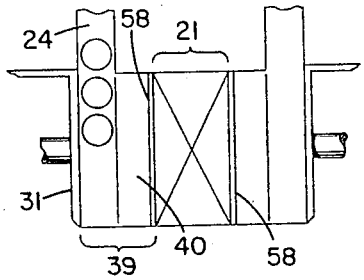
Figure 11F:
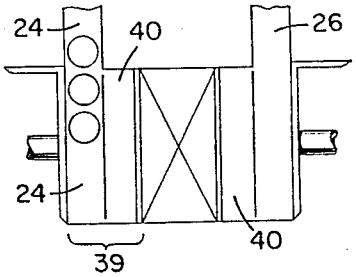
Figure 11K:
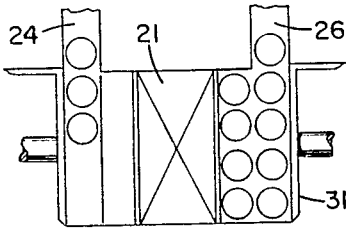
Figure 11B:
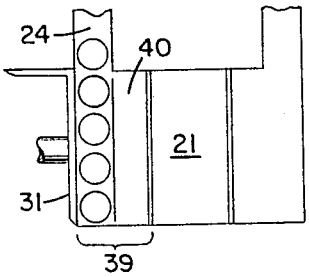

Barrier rods 58 are designed to be used if desired as backstops blocking the advance of filled containers from the two infeed conveyors 24 and 26, across assembly ramps 40, impelled by pusher plates 31 of pushers 29. When the requisite number of rows of filled containers is assembled in either assembly zone 39, as shown in FIG. 11B, the barrier rod 58 may be lowered by extending the piston rod 63 of its actuating cylinder 64, clearing the way for the pusher to propel the assembled containers 27 and 33 into the loading zone 21, as shown in FIG. 11E. The same operation occurs in FIG. 11 I, where the assembled containers 27 and 33 have filled the assembly zone and the barrier rod may then be lowered to allow the pusher to propel these assembled containers into the delivery zone, as shown in FIG. 11J where they may then be gripped by gripper head 34. After the trap doors 41 are opened containers 36 may be lowered by the gripper head 34 through the trap door opening into the underlying cases 23, as indicated in FIG. 3 and by the X in FIG. 11K. As soon as the trap doors are closed, the right-hand assembly zone containers may be propelled by the right-hand pusher into the loading zone, and the pusher then retracts to receive additional filled containers in the assembly zone, as indicated in FIG. 11L while the loading operation proceeds as indicated by the X in loading zone 21 in FIG. 11M.

Figure 12A:
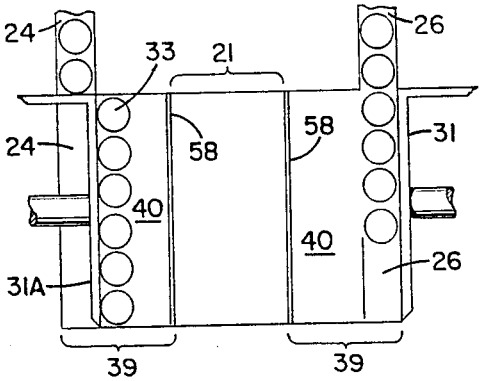
Figure 12B:
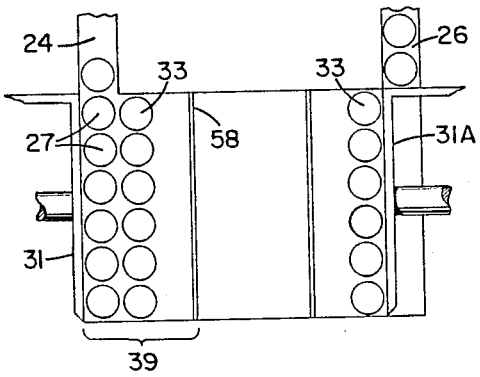
Figure 12C:
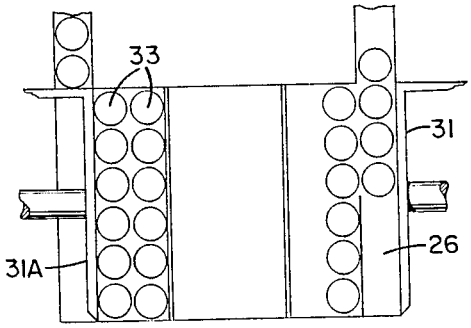
Figure 12D:
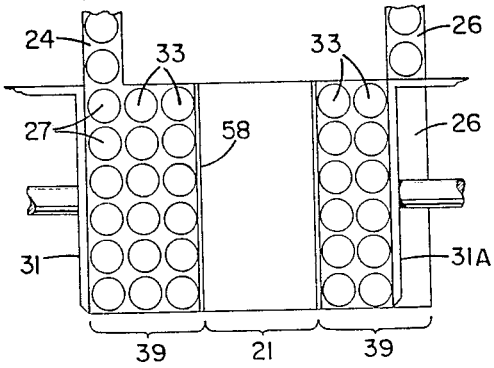
Figure 12E:
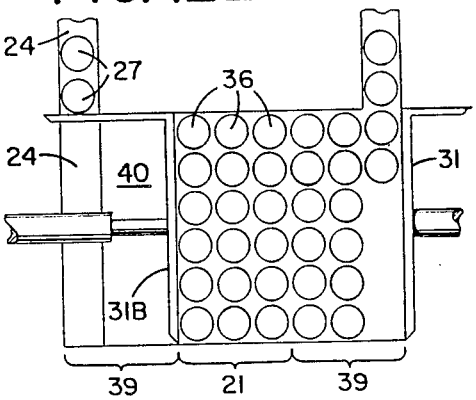
Figure 12F:
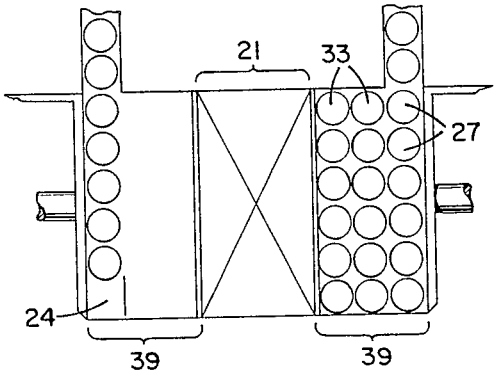
Figure 12G:
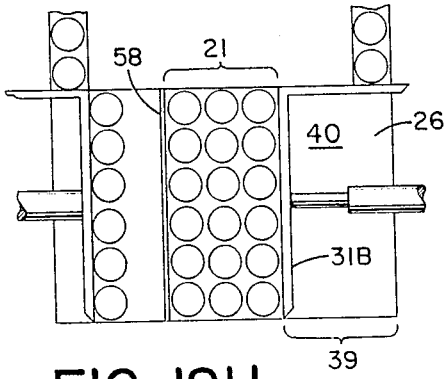

In the same manner , the assembled containers in the left assembly zone of FIG. 12D are ready for loading, and the left barrier rod 58 may then be lowered, allowing the pusher to propel all of these assembled filled containers 27 and 33 into the loading zone, as shown in FIG. 12E, from which they may be loaded as indicated by the X in FIG. 12F. At the same time, as soon as the trap doors 41 have closed, the right-hand assembly zone containers 27 and 33 may be propelled into the loading zone 21 by the right-hand pusher, as indicated in FIG. 12G, and the loading operation may then proceed to lower those filled containers into the underlying cases as indicated by the X in FIG. 12H. The raised position of the barrier rods 58 blocking the sidewise advance of the filled containers from the assembly zone allows the pusher to act briskly and positively, without fear that skidding or over-shooting of any propelled filled containers will push them beyond the assembly zone 39 into loading zone 21 when trap doors 41 stand open during the loading operation shown in FIG. 3.

Lateral Pusher Assemblies

The components incorporated in the lateral pusher assemblies 29 are illustrated in FIG. 4 and are also shown in detail in FIGS. 4A, 5 and 6. As indicated in FIGS. 5 and 6, the pusher assemblies each incorporate two piggy-back pneumatic cylinders, a lower carrier cylinder 67 and an upper pusher cylinder 68. Carrier cylinder 67 is permanently mounted on a stationary carrier plate 69 (FIG. 6) extending laterally from the frame 49 of caser unit 20, peripherally mounted on a cantilever platform 70 extending laterally upward beyond each infeed conveyor such as the infeed conveyor 26 as shown in FIG. 6.

Anchored to the distal end of a piston rod 71 extending from carrier cylinder 67 is a carrier plate 72 shown in FIGS. 7–10. From its retracted position, shown in FIG. 6, carrier plate 72 is advanced by the extension of piston rod 71 from the pneumatic carrier cylinder 67 to its assembly position 72A, shown in solid lines in FIGS. 5, 8 and 10. The retracted position of carrier plate 72 is shown in solid lines in FIGS. 6, 7 and 9, where piston rod 71 has been retracted inside pneumatic carrier cylinder 67. As shown in these views, carrier plate 72 extends lengthwise, beside infeed conveyor 26 in a vertical plane, and both pneumatic cylinders 67 and 68 extend laterally outward horizontally therefrom. While pneumatic carrier cylinder 67 is fixed, being anchored to support plate 69, pneumatic pusher cylinder 68 is anchored only to the outer lateral face of carrier plate 72, and is therefore free to move laterally between the retracted and the extended positions of carrier plate 72.

Thus, the retracted position of pusher cylinder 68 is shown in solid lines in FIG. 6 while its extended position riding behind carrier plate 72 is shown in dash lines in FIG. 6 and in solid lines in FIG. 5. In FIG. 6, the two cylinders 67 and 68 are shown equal in length, while in FIGS. 7 and 9, the pusher cylinder 68 of a slightly modified embodiment of the invention is shown to be shorter than carrier cylinder 67. Thus in FIG. 7 the retracted position of pusher cylinder 68 shows its outer lateral end falling short of the outer lateral end of stationary carrier cylinder 67.

As indicated in FIGS. 5, 6, 7 and 8, carrier plate 72 is stabilized and maintained in its desired orientation relative to infeed conveyor 26 by a pair of guide rods 73 protruding laterally outward from carrier plate 72, slidably extending through linear bearings 74 anchored to fixed support plate 69. Thus as shown in FIGS. 5, 6, 7 and 8, guide rods 73 extending laterally outward from the outer face of carrier plate 72 and slidingly positioned in linear bearings 74 are free to move laterally from the retracted position shown in FIGS. 6, 7 and 9 to the extended left position shown in FIGS. 5, 8 and 10, assuring that each carrier plate 72 will be maintained in its desired lengthwise orientation parallel to the infeed conveyor without rotation about the axis of its piston rod 71.

Mounted on the upstream end of carrier plate 72 facing the approaching filled containers traveling forward along infeed conveyor 26 is gate panel 32. In the retracted position of carrier plate 72 shown in FIG. 4, gate panels 32 extend laterally outward, and their forward edges are clear of all advancing containers on infeed conveyors 24 and 26. In the extended position of carrier plate 72, shown as solid lines in FIG. 5, and also shown in FIGS. 8 and 10, gate panel 32 mounted to the upstream end of carrier plate 72 has moved laterally inward into its blocking position, obstructing further advance of additional filled containers along infeed conveyor 26.

Simultaneous Assembly and Loading Operations

The retracted position of carrier plate 72 and gate panel 32 are shown clearly in FIG. 7 where filled containers 27 are advancing along conveyor 26 in front of the pusher assembly 29. In FIG. 8, however, the pusher assembly has been advanced to the extended position of carrier plate 72, deploying gate panel 32 in its blocking position obstructing the further advance of additional filled containers.

The operation of pusher plate 31 mounted directly in front of the inward face of carrier plate 72 is also shown in FIGS. 5 and 10. The actual contact of the pusher assembly 29 with the advancing filled containers 27 is made by pusher plate 31, carried by carrier plate 72. The pusher plate is stabilized by two laterally extending guide rods 77 protruding outwardly therefrom away from loading zone 21 and slidably engaged in linear bearings 78 mounted on the outer lateral side of carrier plate 72, as shown in FIGS. 5–10.

In the retracted position of pusher plate 31 and carrier plate 72 shown in FIGS. 6 and 7, the advancing containers 27 delivered by conveyor 26 arrive directly in front of the pusher plate 31 in its retracted position. In the extended or "assembly" position of carrier plate 72 shown in solid lines in FIG. 5, and also shown in FIG. 8, pusher plate 31 is in its assembly position 31A. This may be compared with its retracted position 31 shown in FIG. 6, where the pistons of both pneumatic cylinders 67 and 68 are fully retracted, positioning pusher plate 31 and carrier plate 72 laterally beyond the infeed conveyor 26, as shown in FIG. 7. This allows the advancing column of filled containers 27 to move forward along conveyor 26 until they are brought to a stop by the downstream guide plate 37.

Figure 11G:
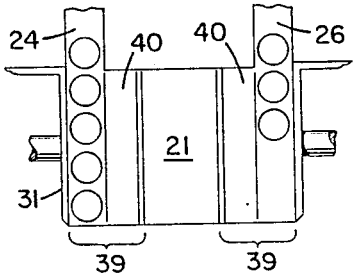
Figure 11L:
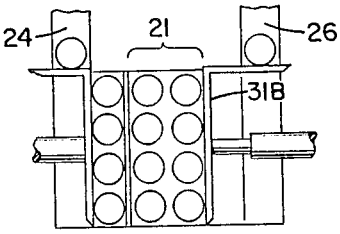
Figure 11C:
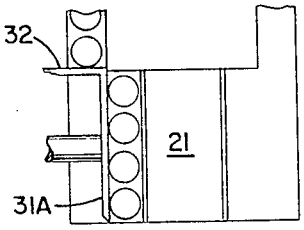
Figure 11H:
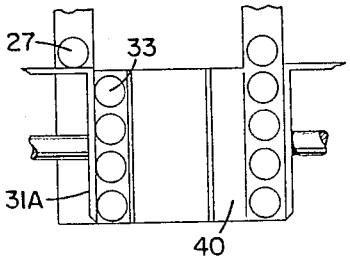

When this advancing column of containers 27 has progressed through the stage illustrated in FIG. 11G, to this stop position shown in FIG. 11H, pusher plate 31 is actuated by the piston rod 71 in carrier cylinder 67, moving pusher plate 31 to its assembly position 31A, as shown in FIGS. 5, 6 and 11 I, and thus propelling the containers 27 directly adjacent to pusher plate 31 onto assembly ramp 40.

When the pusher plate 31 reaches the assembly position 31A illustrated in FIG. 8, these containers now designated assembled containers 33 have thus been moved laterally up to the edge of loading zone 21, as shown in FIG. 3. In this assembly position 31A of the pusher plate, carrier plate 72 has carried gate panel 32 across the infeed conveyor 26, blocking the advance of additional filled containers 27 along the conveyor during the assembly stroke, as illustrated in FIG. 11 I.

The pusher plate is then promptly retracted to its position 31 as shown in FIG. 11J, and gate panel 32 is also retracted, permitting additional containers 27 to advance along the conveyor 26, all as shown in FIG. 11J. It will be noted that containers 27 arriving on the left infeed conveyor 24 have now accumulated to fill the opposite assembly zone 39 in FIG. 11 I. In FIG. 11J the opposite or left pusher plate has advanced to its loading position 31B, propelling these assembled containers 27 and 33 into the central loading zone 21, where they are deployed for case-loading and designated as containers 36 in the drawings.

In FIG. 11K the loading zone 21 is designated by an X, indicating that the trap doors 41 have opened and the carrier 34 is lowering the containers 36 into the case 23 below the loading zone 21. During this operation, the filled containers 27 continue to advance along both infeed conveyors 24 and 26. Immediately upon the closing of trap doors 41, the right hand pusher plate 31 can move all of its assembled containers 27–33 directly into the loading zone 21 (FIG. 11L), while containers arriving on the left conveyor 24 continue to be assembled in their assembly zone. This loading stroke is illustrated in FIG. 11L, with the pusher plate 31 fully extended to its loading position 31B, with these containers from infeed conveyor 26 delivered to the loading zone 21. FIG. 11N shows the opposite advance of the left pusher to its loading position 31B, as in FIG. 11J, where the assembled containers from conveyor 24 are all delivered into loading zone 21 while containers from conveyor 26 continue to be assembled. FIG. 11P, like FIGS. 11K and 11M, indicates by an X the open trap doors of loading zone 21 where the loading of containers into the underlying cases is in progress, while assembly continues in both assembly zones as filled containers 27 advance along both infeed conveyors.

The fully extended loading position 31B of the pusher plate, propelling the assembled containers 27–33 into the loading zone 21 is shown in FIGS. 9 and 10. The pusher plate moves through its loading stroke from its fully retracted position 31 shown in FIG. 9 to its fully extended position 31B shown in FIG. 10, with carrier plate 72 extended and gate panel 32 blocking the advance of new containers 27 down the conveyor 26. When the pusher plate 31 is advanced by the extension of piston rod 76, the pusher plate 31 is thus moved to its furthest extended position 31B, as shown in FIGS. 11E, 11J, 11L and 11N.

The arrival of the filled containers, traveling along infeed conveyor 26, at the downstream end guide plate 37 may be sensed by a suitable sensor transducer or limit switch 79 shown in FIGS. 7–10. Similar limit switches may be installed in a conventional manner to signal the arrival of empty cases 23, filled containers 27 or filled cases 23 at desired stations. Fixed or adjustable stops may be installed such as fixed stops 81 (FIG. 4A) limiting the downward movement of each crank arm 43 to determine the closed position of each trap door 41, or the adjustable stops 82 limiting the upward movement of the same crank arms 43 to provide the desired opening angle of the lowered trap doors 41. All of these stops and their cooperation with the articulating linkage are shown in FIG. 4A.

Efficient High-Speed Operation

The modular casers of the present invention are well adapted for casing operations at the downstream end of a single infeed conveyor 24 as shown in FIGS. 11A–11E. This facilitates the installation of these modular casers in dairies operating a single filling line feeding one infeed conveyor 24 while permitting the installation of a second filler line and infeed conveyor 26 at any later time. As shown in FIGS. 11A–11E, infeed conveyor 24 delivering filled containers 27 produces a single column of containers in front of the pusher plate 31 in FIG. 11B. The pusher plate 31 then performs its assembly stroke to its assembly position 31A, propelling the first row of filled containers 27 onto the assembly ramp 40, and then retracts immediately to receive the second row of filled containers in FIG. 11D. The pusher plate then performs its loading stroke to its loading position 31B, as shown in FIG. 11E, propelling all of the assembled containers 27 and 33 directly to the loading zone 21. The cycle can then be immediately repeated as the trap doors open in FIG. 11F to permit the gripper head 34 to seize, grip and lower the containers through the loading zone into the underlying case 23 while a new column of filled containers 27 is simultaneously delivered by the conveyor 24 into the assembly zone 39, as indicated in FIGS. 11A and 11F.

When two infeed conveyors 24 and 26 are both delivering filled containers, as shown in FIGS. 11F through 11P, the same advantages of assembling a group of filled containers while the loading operation is in progress can be realized in the same manner; additionally, the assembling and loading stages for containers delivered by both conveyors 24 and 26 may be alternated. Thus assembly of the containers delivered by conveyor 24 proceeds in FIGS. 11F through 11I in the same manner as that shown in FIGS. 11A through 11D; the delivery of these containers to the loading zone 21 is performed in FIG. 11J in the same manner that it is performed in FIG. 11E, and during this period the assembly of containers delivered by the second infeed conveyor 26 is also continuing as shown in FIGS. 11F through 11J.

Figure 11M:
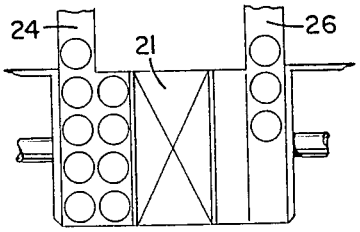
Figure 11D:
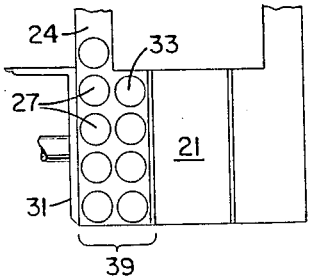
Figure 11I:
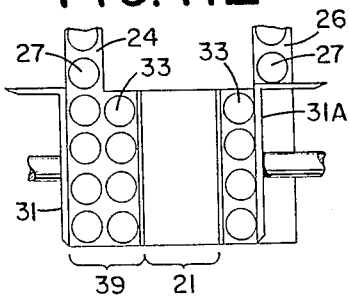
Figure 11N:
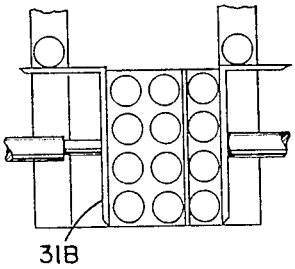
Figure 11E:
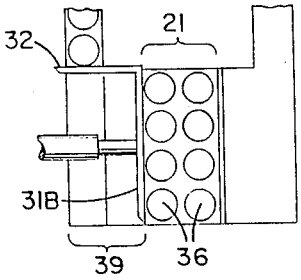
Figure 11J:
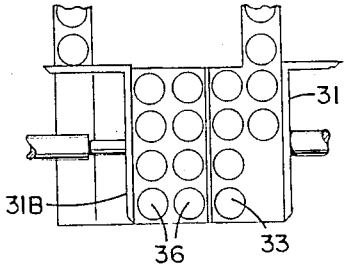
Figure 11P:
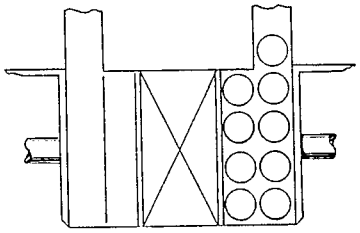

During the loading operation performed on the assembled containers from conveyor 24, indicated by the X in FIG. 11K, the assembly of containers delivered by the second infeed conveyor 26 is completed and immediately at the conclusion of this first loading operation, the trap doors close and the right-hand pusher delivers the assembled containers from conveyor 26 directly to the loading zone 21 so that the next loading operation follows promptly, as shown in FIG. 11M. This same alternating loading operation thus is illustrated in FIGS. 11K, 11M, and 11P, significantly increasing the speed of the casing operation and closely approaching the containers per minute filling rate of the entire container filling operation, thus virtually eliminating a casing bottleneck in beverage bottling plants or dairies.

In FIGS. 11A–11P and 12A–12H, the respective pushers are shown as single pusher plates with single gate panels incorporated therein for simplicity of illustration. The preferred forms of the caser of this invention illustrated in the FIGS. 1–10 incorporate the compound pusher assembly of carrier plate 72 and pusher plate 31, with the two "piggy-back" actuating cylinders 67 and 68 shown in FIGS. 5–10 aligned by the guide rods 73 and 77 and linear bearings 74 and 78 for smooth, low-friction operation and accurate, stable positioning of these moving parts.

FIGS. 12A–12H show a modified embodiment of the invention, capable of loading nine half gallon containers respectively into each of two underlying cases 23 simultaneously. As shown in FIG. 12A, a column of six containers 27 delivered by each of the infeed conveyors 24, 26 accumulates in front of each pusher plate 31 and when the entire column of six has arrived in front of the pusher plate, the plate is then moved into its intermediate extended "assembly" position 31A as shown by the left-hand pusher plate in FIG. 12A, propelling the entire column of containers 33 forward one container width into the central ramp 40 portion of the assembly zone 39. The pusher plate immediately retracts to its original position 31 and a second column of filled containers 27 is then delivered to fill the space directly in front of the pusher plate as shown in FIG. 12B. The pusher plate again advances to its intermediate extended assembly position 31A, as shown in FIG. 12C, propelling both columns of filled containers forward to fill the balance of the assembly zone 39 between the infeed conveyor 24 and the barrier rod 58 demarking the edge of the loading zone 21. Upon the arrival of the third column of filled containers 27 in front of the pusher plate, as shown in FIG. 12D, left barrier rod 58 is lowered and the entire assembled group of containers 27 and 33 is transferred from assembly zone 39 to loading zone 21, as shown in FIG. 12E, where the left pusher plate is shown in its forwardmost extended position 31B. Throughout the previous stages illustrated in FIGS. 12A–12E the right hand infeed conveyor 26 has likewise been delivering filled containers 27, and these have also been advanced in successive columns into the right hand assembly zone 39.

In FIG. 12F the gripping, loading and lowering operation performed in the loading zone 21 is represented by the X symbol in the loading zone. Immediately after the completion of the loading operation and the closing of trap doors 41 under loading zone 21, the right-hand barrier rod 58 is lowered, and the entire group of containers 27 and 33 assembled in the right-hand assembly zone 39 (FIG. 12F) is propelled from zone 39 into loading zone 21 to the position shown in FIG. 12G, with the right-hand pusher plate having reached its forwardmost extended position 31B.

Figure 12H:
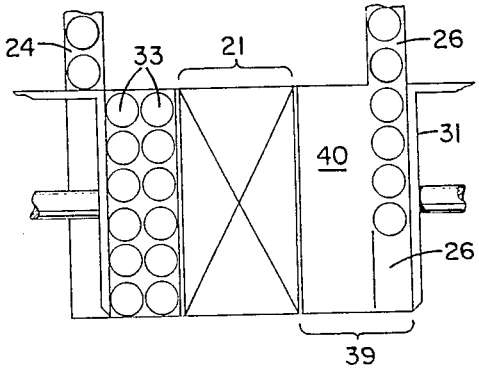

The right-hand pusher plate is then retracted to the position 31 shown in FIG. 12H and during the loading operation again represented by the X in loading zone 21, both infeed conveyors 24 and 26 continue to deliver filled containers 27 to the caser, and assembled columns of filled containers are successively advanced by the two pusher plates into the respective assembly zones 39. As soon as the left assembly zone 39 is filled, as shown in FIG. 12D, the left-hand barrier rod 58 is lowered and the left pusher again propels all of the assembled containers from assembly zone 39 to loading zone 21, as shown in FIG. 12E, and the same series of stages is repeated in a continuing cycle.

The following Table I shows the various patterns which may be assembled and loaded in cases of different sizes by the casers of this invention.

TABLE I

| Bottle | Size | Patterns in Each Case |
|---|---|---|
| Gallon | 6" | 2 × 2 |
| | | 2 × 3 |
| Half Gallon | 4" | 3 × 3 |
| | | 3 × 2 |
| | | 4 × 3 |
| Quart and smaller | 3" | 4 × 4 |
| | | 5 × 4 |
| | | 6 × 4 |
| | | 4 × 3 |
| "Ecopak" | 2.4" | 5 × 5 |
| | | 6 × 5 |
| | | 7 × 5 |
| | | 5 × 4 |

For each of the different sizes of standard dairy containers of polyethylene or wax coated cartons, by adjusting the size and position of the pushers and guide plates, and changing the stroke of the pusher plates' intermediate assembly position 31A, different numbers of columns of filled containers may be assembled in the assembly zone 39 and thence delivered en masse to loading zone 21.

With suitable control programming, a partial top layer of half-pint containers may be lowered into the topmost region of the loaded case into a diagonally arrayed position, in which the topmost rows of these small containers all lean in the same direction, and nestle between the tops of the underlying layer of filled containers in the case.

Gripper head 34 is preferably dimensioned and programmed to descend automatically and grip the assembled containers 36 in the loading zone 21 as indicated in FIG. 10 just prior to the opening of trap doors 41. When two underlying cases 23 are being filled by suitable patterns of containers, it may be desirable to program a slight indexing movement into the gripper action in the gripper head 34 so that the containers for the upstream case 23 will be moved slightly upstream by a short distance and the containers to be lowered into the downstream case 23 will be moved downstream by a similar short distance. Thus the two groups of containers 36 are separated by a double wall thickness of the two adjacent cases 23 standing ready to be filled below loading station 21. This slight indexing movement facilitates smooth rapid loading descent of the filled containers 36 as they are lowered briskly into the underlying cases 23, as shown in FIG. 3. As there shown, case 23 may be a corrugated cardboard carton, and a pair of upper flaps 83 projecting upward from the tops of the sidewalls of each case 23 are held apart by the lowered trap doors 41 to provide ready access for the descending filled containers 36 lowered by gripper head 34 into the case 23, all as shown in FIG. 3.

FIGS. 4, 4A, 11 and 12 clearly illustrate the lateral width of each assembly zone 39, extending from the retracted position 31 of the pusher plate across the infeed conveyor and the entire assembly ramp 40 to the edge of loading zone 21 at the pivoted shaft 42 on which trap doors 41 are mounted. By encompassing both the assembly ramp and the adjacent delivery end of the infeed conveyor, two, three or more columns of containers 27 and 33 are assembled in one assembly zone 39 during the loading of previously assembled containers, as shown in FIGS. 11K and 12F, ready for immediate transfer to the loading zone 21 as soon as it is empty as shown in FIGS. 11L and 12G. When two infeed conveyors and two assembly zones 39 are employed, containers are assembled in both assembly zones during the loading into cases, efficiently achieving high speed casing of filled containers at casing rates closely approaching the maximum container filling rates of upstream filling operations. Casing bottlenecks are this minimized or eliminated, and all phases of filling and casing operations in the bottling plant or dairy are performed with comparable high speed and efficiency.

It will thus been seen that the objects set forth above, and those made apparent from the preceding description, are efficiently attained and, since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A caser for assembling objects advancing along an infeed conveyor line into at least two parallel columns of objects, and transferring these assembled columns of objects simultaneously to a loading zone for case loading, during which assembly of succeeding columns of objects begins before case loading is completed, comprising A. a frame enclosing (1) a central loading zone positioned to receive a plurality of columns of assembled objects for casing, and (2) two assembly zones each including an assembly ramp adjacent to and flanking said loading zone, B. two infeed conveyors each delivering objects into one said assembly zone beside said assembly ramp opposite to said loading zone, and C. two pusher assemblies mounted on said frame and each having a reciprocating pusher plate movable between a retracted position beside one said conveyor facing the assembly ramp, and two extended positions, (1) a first assembly position across the conveyor above the adjacent assembly ramp, and (2) a second, further extended loading position at the remote edge of the adjacent assembly zone facing the loading zone, whereby independently in each assembly zone a first column of objects delivered by each infeed conveyor in front of its retracted pusher plate is propelled onto the adjacent assembly ramp by the pusher plate as it reaches its first assembly position, after which the pusher plate is retracted, a second column of objects is delivered in front of the retracted pusher plate, and as the pusher plate then advances to its second, loading position, both columns are propelled across the assembly ramp into the loading zone, from which the objects are automatically seized, gripped and loaded into case means while the pusher plate is retracted and succeeding columns of objects are assembled in the assembly zone.

2. The caser defined in claim 1 wherein each assembly zone encompasses an assembly ramp dimensioned to hold at least two assembled columns of objects and the delivery end of the associated infeed conveyor, whereby each advance of each pusher plate to its second loading position propels at least three columns of objects from said adjacent assembly zone into the loading zone.

3. The caser defined in claim 1, further including

D. a case conveyor delivering empty cases to a casing position beneath said loading zone, E. pivoted trapdoor means underlying the loading zone and movable between (1) an upper object-supporting position, and (2) a downwardly pivoted open position providing direct access from the loading zone to the cases in the casing position, and F. gripper head means positioned above the loading zone movable between (1) an upper gripping position, releasably seizing and gripping objects supported on the trap door means in the loading zone, and (2) a lower casing position, delivering said gripped objects to the empty cases and releasing them therein, whereby columns of objects propelled by each said pusher plate into the loading zone are seized and gripped while supported on said trapdoor means, after which the trapdoor means moves to its pivoted open position and the gripped objects are lowered therethrough into said empty cases, while succeeding columns of objects delivered by both infeed conveyors are simultaneously being assembled in their respective assembly zones.

4. The caser defined in claim 1 wherein each pusher assembly incorporates a carrier plate actuated by a pneumatic carrier cylinder-piston assembly, anchored to the frame, for movement across the adjacent infeed conveyor between a retracted position and an advanced position, and a piggy-back pneumatic pusher cylinder-piston assembly connecting the pusher plate to the carrier plate, for movement between the extended loading position of the pusher plate and a second position adjacent to the carrier plate, whereby the carrier plate in its own retracted position carries the pusher plate to its retracted position, and when the carrier plate is in its advanced position, the pusher plate may be moved between its two extended positions by operation of the piggy-back pneumatic pusher cylinder-piston assembly.

5. The caser defined in claim 4 wherein the carrier plate is provided with a laterally extending gate panel positioned to block objects advancing on the adjacent infeed conveyor in the advanced position of the carrier plate, and which is withdrawn laterally to clear the infeed conveyor when the carrier plate moves to its retracted position.

6. The caser defined in claim 3, further including barrier means positioned along said remote edge of each assembly zone, movable between a retracted position, not impeding the delivery of objects to the loading zone, and a blocking position preventing the movement of objects from the assembly zone to the loading zone.

7. A method for assembling onto predetermined group patterns and alternately delivering en masse to a loading zone corresponding pluralities of objects advancing along two infeed conveyors, utilizing a first assembly ramp having a first edge contiguous with a first side of the loading zone and a second opposite edge adjacent to the first conveyor, and also utilizing a second assembly ramp having a first edge contiguous with the second opposite side of the loading zone, and a second opposite edge adjacent to the second conveyor, each said assembly ramp and the adjacent portion of its conveyor forming respective assembly zones flanking said loading zone, comprising the steps of A. receiving a predetermined number X of objects in a first column on the conveyor portion of the first said assembly zone, B. pushing the entire first column X of objects simultaneously from said conveyor portion of the first assembly zone onto the first assembly ramp while blocking the advance of additional objects along the first conveyor, C. receiving a second number X of objects in a second column on the conveyor portion of said first assembly zone, D. independently, while steps A, B and C are performed, performing the same steps upon the conveyor portion and assembly ramp forming the second assembly zone, E. pushing both first and second columns of objects simultaneously across the first assembly zone into the loading zone while blocking the advance of additional objects along the first conveyor, F. transferring en masse to adjacent case means both first and second columns of said objects from the loading zone, G. pushing both first and second columns of objects simultaneously across the second assembly zone into the loading zone while blocking the advance of additional objects along the second conveyor, and H. repeating steps A through G in continuous cycles, whereby the assembly of group patterns of objects continues on each assembly ramp and its adjacent conveyor simultaneously while objects delivered to the loading zone are being transferred to case means, thus increasing the speed and efficiency of the assembly, loading and casing operations.

8. The method defined in claim 7 wherein each step B is repeated at least once before the following steps C and E are performed and before the following steps C and G are performed, delivering the assembled plurality of at least three columns of objects from each assembly ramp and its adjacent conveyor into the loading zone before each casing step F is performed.

* * * * *